US007033537B2

(12) United States Patent
Shoji et al.

(10) Patent No.: US 7,033,537 B2
(45) Date of Patent: Apr. 25, 2006

(54) PROCESS FOR PRODUCING CONTINUOUS ALUMINA FIBER BLANKET

(75) Inventors: Mamoru Shoji, Niigata-ken (JP); Norio Ikeda, Niigata-ken (JP); Toshiaki Sasaki, Niigata-ken (JP)

(73) Assignee: Mitsubishi Chemical Functional Products, Inc., Tokyo (JP)

( * ) Notice: Subject to any disclaimer, the term of this patent is extended or adjusted under 35 U.S.C. 154(b) by 595 days.

(21) Appl. No.: 10/349,833

(22) Filed: Jan. 23, 2003

(65) Prior Publication Data

US 2003/0160350 A1 Aug. 28, 2003

Related U.S. Application Data

(63) Continuation-in-part of application No. PCT/JP02/05003, filed on May 23, 2002.

(30) Foreign Application Priority Data

May 24, 2001 (JP) ..... 2001-155820
May 24, 2001 (JP) ..... 2001-155821

(51) Int. Cl.
*B29C 31/00* (2006.01)

(52) U.S. Cl. ..... 264/653; 264/639; 264/640; 264/642; 264/681; 264/257; 264/258; 264/280

(58) Field of Classification Search ..... 264/103, 264/130, 141, 241, 249, 257, 258, 280, 640, 264/211.14, 211.17, 639, 671, 662, 681, 642, 264/DIG. 19, 653; 110/185
See application file for complete search history.

(56) References Cited

U.S. PATENT DOCUMENTS 2,144,151 A 1/1939 Heinen
(Continued)

FOREIGN PATENT DOCUMENTS

EP 0 971 057 A1 12/2000
(Continued)

OTHER PUBLICATIONS

European Patent Office Search Report dated Jun. 6, 2005.

*Primary Examiner*—Steven P. Griffin
*Assistant Examiner*—Carlos Lopez
(74) *Attorney, Agent, or Firm*—David G. Conlin; Edwards Angell Palmer & Dodge -LLP

(57) ABSTRACT

A process for producing a continuous alumina fiber blanket by heat treating an alumina fiber precursor formed from a spinning solution containing an aluminum compound, by using a specific high-temperature furnace capable of high-temperature heat treatment. According to this process, a continuous sheet (W) of alumina fiber precursor formed from a spinning solution containing an aluminum compound is supplied continuously into a high-temperature furnace and subjected to heat treatment while being conveyed in one direction by plural conveying mechanisms (2, 3) disposed in said high-temperature furnace. In this operation, the speed of said conveying mechanisms is reduced progressively in the direction of conveyance in correspondence to the rate of heat shrinkage of the continuous sheet (W) of alumina fiber precursor, thereby to lessen fiber crush in the alumina fiber precursor and obtain a continuous alumina fiber blanket with uniform thickness and high bulk density as well as high strength.

6 Claims, 2 Drawing Sheets

U.S. PATENT DOCUMENTS

| | | | | |
|---|---|---|---|---|
| 4,348,341 | A * | 9/1982 | Furuya et al. | 264/8 |
| 4,752,515 | A | 6/1988 | Hosoi et al. | 428/114 |
| 4,931,239 | A * | 6/1990 | Hosoi et al. | 264/627 |
| 5,145,734 | A * | 9/1992 | Ito et al. | 442/187 |
| 5,380,580 | A * | 1/1995 | Rogers et al. | 428/219 |
| 6,602,369 | B1 * | 8/2003 | Shoji et al. | 156/89.11 |
| 6,746,979 | B1 * | 6/2004 | Shoji et al. | 501/95.1 |

FOREIGN PATENT DOCUMENTS

| | | |
|---|---|---|
| JP | 55-045808 | 3/1980 |
| JP | 62-021821 | 1/1987 |
| JP | 62-78216 | 4/1987 |
| JP | 5-132824 | 5/1993 |
| JP | 8-49155 | 2/1996 |
| WO | WO 02/095116 A1 | 11/2002 |

* cited by examiner

GRAPH IN EXAMPLES AND COMPARATIVE EXAMPLE

PROCESS FOR PRODUCING CONTINUOUS ALUMINA FIBER BLANKET

CROSS REFERENCE TO RELATED APPLICATION

This is a continuation-in-part of PCT application No. PCT/JP02/05003, filed May 23, 2002.

BACKGROUND OF THE INVENTION

The present invention relates to a process for producing a continuous alumina fiber blanket. More particularly, it relates to a process for producing a continuous alumina fiber blanket by subjecting an alumina fiber precursor formed from a spinning solution containing an aluminum compound to a heat treatment by using a specific high-temperature furnace.

Continuous blankets (continuous sheets) of alumina fiber are used, by vacuum molding them, as various types of heat-resisting materials, for example, heat insulator or joint filler of high-temperature furnaces or high-temperature ducts, and retainer of catalyst converter for cleaning exhaust gas from internal combustion engines. As the method of producing a continuous alumina fiber blanket, a process is known in which a continuous sheet of alumina fiber precursor formed from a spinning solution containing an aluminum compound is supplied continuously to a high-temperature furnace and subjected to a heat treatment therein while being carried in one direction by a carrying mechanism such as conveyor disposed in the said high-temperature furnace. (For example, European Patent Application Laid-Open No. 971057 (Japanese Patent Application Laid-Open (KOKAI) No. 2000-80547)).

However, in the above method, there is a possibility that the fibers in the blankets might be crushed or broken in the course of their production process, and there may arise such problems as non-uniformity of thickness or bulk density and insufficient strength of the product.

SUMMARY OF THE INVENTION

As a result of earnest studies of the present inventors on the treating process of alumina fiber precursor using a high-temperature furnace, the following finding have been found. In a high-temperature furnace, the alumina fiber precursor, which is an aggregate of fine fibers, is conveyed at a constant speed, but since the alumina fiber precursor is shrunk by high-temperature heating, the fibers may be crushed by friction with the conveying mechanism when the fibers are shrunk.

The present invention has been made in view of the above circumstances, and its object is to provide a process for producing a continuous alumina fiber blanket by subjecting an alumina fiber precursor formed from a spinning solution containing an aluminum compound to a heat treatment, the produced blanket being improved in that the crush of fibers is lessened and the blanket is made homogeneous throughout.

The present invention has been completed as a result of further studies based on the above finding, and an aspect of the present invention is to provide a process for producing a continuous alumina fiber blanket which process comprises continuously supplying into a high-temperature furnace a continuous sheet of alumina fiber precursor formed from a spinning solution containing an aluminum compound, and subjecting the sheet to heat treatment while conveying it in one direction by a conveying mechanism disposed in said high-temperature furnace, the speed of said conveying mechanism being reduced progressively in the direction of conveyance in correspondence to the rate of heat shrinkage of the continuous sheet of alumina fiber precursor.

DETAILED DESCRIPTION OF THE INVENTION

Figure 1A:
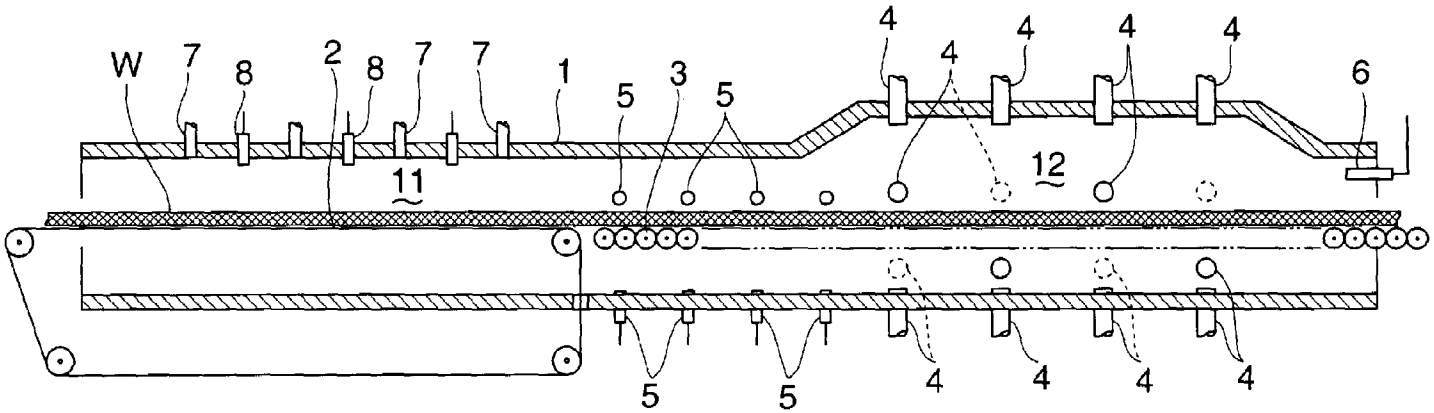
FIG. 1 is an illustration of an example of high-temperature furnace used for the heat treatment of a continuous sheet of alumina fiber precursor in a preferred embodiment of the present invention, wherein (a) is a longitudinal sectional view of the high-temperature furnace cut along its length, and (b) is a graph showing temperature distribution in the furnace along its length.

Hereinafter, the embodiments of the present invention are explained in detail based on the accompanying drawings.

The continuous alumina fiber blanket producing process according to the present invention is basically the same as the process described in European Patent Application Laid-Open No. 971057 except for the method of heat treatment (calcination and crystallization) of the alumina fiber precursor. In the present invention, a continuous sheet of alumina fiber precursor formed from a spinning solution containing an aluminum compound is supplied continuously into a furnace and subjected to a heat treatment while it is conveyed in one direction by plural units of conveying mechanism disposed in the said furnace.

Production of the alumina fiber precursor from a spinning solution can be accomplished according to a conventional method. As the spinning solution, there is used a basic aluminum chloride solution to which silica sol has been added so that the finally obtained alumina fiber composition would be $Al_2O_3$:$SiO_2$=usually 65 to 98:35 to 2, preferably 70 to 97:30 to 3 (by weight). In order to improve spinning properties, usually a water-soluble organic polymer such as polyvinyl alcohol, polyethylene glycol, starch, cellulose derivative or the like is added to the spinning solution. Also, viscosity of the spinning solution is adjusted as required to be around 10 to 100 poises by concentration process.

Formation of the alumina fiber precursor (fiber) from the spinning solution is performed by a blowing method in which the spinning solution is supplied into a high-speed spinning stream or a spindle method using a rotating plate. There are two types of arrangement of spinning nozzle used in the blowing method: in one arrangement, the spinning nozzle is installed in the stream nozzle which generates the spinning stream, and in the other arrangement, the spinning nozzle is set so that the spinning solution will be supplied from outside of the spinning stream. Both types of arrangement can be used in the present invention. The blowing method is preferable as it is possible to form alumina fiber precursor (fibers) having a size of usually several μm and a length of several ten to several hundred mm, thus allowing formation of long fibers.

A continuous sheet of the said alumina fiber precursor is usually formed by first forming thin-gage sheets by spinning by the said blowing method and then laminating these thin-gage sheets. For forming the thin-gage sheets of alumina fiber precursor, there is preferably used an accumulation equipment of the structure in which a wire mesh endless belt is set substantially perpendicularly to the spinning stream, and with the endless belt being rotated, a spinning stream containing alumina fiber precursor (fibers) is let impinge against it.

A continuous sheet (laminated sheet) of alumina fiber precursor is produced, for instance, by continuously delivering thin-gage sheets from the accumulation equipment, supplying them to a folding device whereby to fold the sheets to a predetermined width and stack them, and continuously moving the stacked sheets in the direction perpendicular to the folding direction. Thereby both ends of the thin-gage sheets in the width direction are positioned inside of the formed laminated sheet, so that the basis weight of the laminated sheet is uniformalized throughout the sheet.

The basis weight of thin-gage sheet is usually 10 to 200 $g/m^2$, preferably 30 to 100 $g/m^2$. This thin-gage sheet may not necessarily be uniform in both of its width direction and longitudinal direction. Therefore, the laminated sheet is formed by stacking the thin-gage sheets in at least 5 layers, preferably not less than 8 layers, especially 10 to 80 layers. This can offset partial non-uniformity of the thin-gage sheets to ensure uniform basis weight throughout the laminated sheet.

The said alumina fiber precursor laminated sheet is calcined by a heat treatment at a temperature of usually not lower than 500° C., preferably 1,000 to 1,300° C., to make a laminated sheet of alumina fiber (alumina fiber blanket). By conducting needling on the laminated sheet prior to the heat treatment, it is possible to make an alumina fiber sheet of high mechanical strength in which alumina fibers are oriented in the thickness direction. The rate of punching by needling is usually 1 to 50 punches per $cm^2$, and generally, the higher the rate of punching, the larger the bulk density and peel strength of the alumina fiber sheet.

In the present invention, the continuous sheet of alumina fiber precursor obtained in the manner described above is subjected to a specific heat treatment by using a specific high-temperature furnace. More specifically, the continuous sheet of alumina fiber precursor is heat treated while it is conveyed in one direction by a conveying mechanism disposed in a high-temperature furnace, wherein the speed of the said conveying mechanism is reduced progressively in the direction of conveyance in correspondence to the rate of heat shrinkage of the continuous sheet of alumina fiber precursor.

As for the way of reducing the speed of the conveying mechanism in the direction of conveyance in correspondence to the rate of heat shrinkage of the continuous sheet of alumina fiber precursor, it is ideal to reduce the conveying speed continuously in accordance with the rate of heat shrinkage, but actually the conveying speed may be reduced intermittently. Usually, the most simple method is to reduce the speed halfway in the course of conveyance. For example, a method is exemplified in which supposing that the size of the sheet in the direction of conveyance (longitudinal direction) before shrinkage is x, the size after shrinkage is y, and the rate of shrinkage is expressed by $\{(x-y)/x\}\times 100$, the conveying speed is reduced by about 10 to 30% at the stage where the final shrinkage rate is 30 to 70%. In case where the speed is reduced halfway in the course of conveyance, it is preferable that speed reduction be made stepwise in correspondence to the rate of heat shrinkage.

As explained above, the speed of the said conveying mechanism is reduced in the direction of conveyance in correspondence to the rate of heat shrinkage of the continuous sheet of alumina fiber precursor. Here, it is usually preferable to set the interior of the high-temperature furnace so that the temperature in the furnace will elevate gradually in the direction of conveyance from the inlet of the furnace, with the maximum temperature being fixed at 1,000 to 1,300° C., and will drop close to ordinary temperature just before the outlet of the furnace. Switching of conveying speed in the said conveying mechanism may be decided by observing the rate of shrinkage, but usually such switching is preferably made at the stage where temperature in the furnace is 300 to 800° C., preferably 400 to 600° C.

Figure 1B:
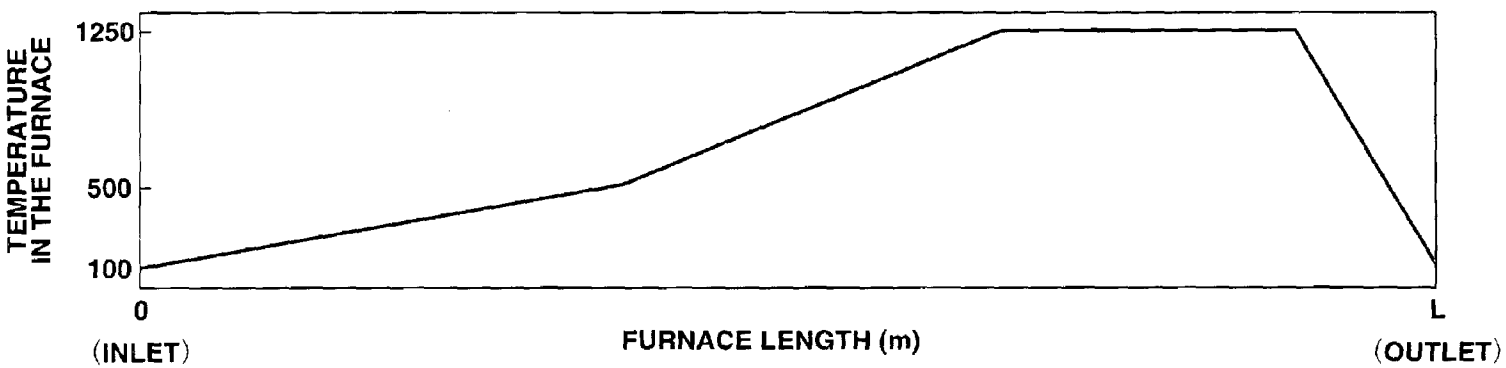

In the said calcination, it is possible to use a high-temperature furnace of a structure such as shown in FIG. 1. The furnace shown in FIG. 1 is the one used for the heat treatment of a continuous sheet (W) of alumina fiber precursor (hereinafter referred to as "precursor") which is a fiber aggregate such as described above, and having a tunnel type furnace body (1). Furnace body (1) comprises a combination of framing made of a refractory metal such as stainless steel and walling (ceiling, flooring and side walling) composed of the same type of metal plates and provided with a refractory on the inner side. Furnace body (1) may be constituted by a combination of the said framing and walling made of a heat-resistant material such as refractory brick.

The sectional shape (of the interior) of furnace body (1) vertical to the longitudinal direction of the furnace can be selected from various forms such as square, circular, oval, dome-like in the upper half, etc., by taking into consideration such factors as thermal efficiency, form of the precursor and its strength. The length of furnace body (1) (furnace length) is variable depending on the schemed time of treatment and conveying speed of the conveying mechanism described later, but generally it is about 20 to 100 meters.

The rear treating chamber (roughly the rear half portion) (12) of furnace body (1) along the furnace length has a structure in which, when viewed sidewise, the ceiling section bulges out in comparison with the front treating chamber (roughly the first half portion) (11) of the furnace, that is, the rear treating chamber (12) has a structure whose ceiling height is high as compared with the front treating chamber (11). In the furnace, by constructing the rear treating chamber (12) of furnace body (1) to have a structure whose ceiling height is higher, it becomes possible to let high-temperature gas stay in this chamber and to set the temperature of rear treating chamber (12) at a higher temperature by a heating mechanism described later.

In the interior of the furnace, a higher temperature is set along the length of the furnace, that is, rear treating chamber (12) is set at a higher temperature than front treating chamber (11), by means of the above-described structure of furnace body (1) and the heating mechanism described later. More specifically, several burners (4) are disposed in rear treating chamber (12) of furnace body (1). Burners (4) are placed in both side walls, ceiling and floor of furnace body (1) so that precursor (W) on roller conveyor (3) described later will be heated from both upper and lower sides. Each burner (4) is designed to supply combustion gas from a gas feeder (not shown) at a prescribed rate, while combustion air is supplied from a blower (not shown) at a prescribed rate. As the heating means, there can be used, beside the direct firing burners such as mentioned above, indirect heating means such as radiant tubes or electric heaters.

In both side walls and floor at the middle of furnace body (1), there are also provided air nozzles (5) designed to supply air and to adjust the interior temperature at the middle of furnace body (1). To these air nozzles (5), air is supplied at a prescribed rate from an outside blower (not shown). In front treating chamber (11) of furnace body (1), several exhaust pipes (7) for discharging combustion exhaust gas from the inside of the furnace are provided in the ceiling. Exhaust pipes (7) are connected to an exhaust fan (not shown) provided outside of the furnace.

Further, in the ceiling of front treating chamber (11) of furnace body (1), air blowing nozzles (8) for adjusting the furnace interior temperature in front treating chamber (11) may be provided adjacent to the respective exhaust pipes (7). At the outlet of furnace body (1), as shown in FIG. 1, there is provided a cooling air nozzle (6) for supplying air and maintaining the temperature in the furnace at its outlet portion at a low temperature. To this cooling air nozzle (6), room temperature air is supplied at a prescribed rate through an outside fan (not shown).

Thus, in the furnace shown in FIG. 1, heat of the burners generated in rear treating chamber (12) of furnace body (1) is sent toward the inlet side of the furnace contrary to the direction of conveyance, causing the temperature in the furnace to rise up gradually from the inlet toward the outlet of furnace body (1), with the furnace inside temperature becoming highest in rear treating chamber (12) (see FIG. 1(*b*)).

Also, in the furnace, a conveying mechanism for conveying the said precursor (W) from the inlet to the outlet of the furnace body along its length is passed through the furnace. As the conveying mechanism, generally a refractory roller conveyor is preferably used in view of the requirements that the said mechanism must be made of a material which can withstand high temperature of around 1000° C., that the mechanism must have a structural form which allows smooth release of water vapor and gasses generated from the continuous sheet, and that the mechanism must have a structure easily adaptable in the furnace body. However, the precursor (W) such as the said alumina fiber precursor has the problem that before it is sufficiently heat treated, the fiber itself is sensitive to water and absorbs ambient moisture to become sticky and also the fibers are turned into nappy loops by the action of the organic polymers such as polyvinyl alcohol and become liable to get caught by the rotating bodies such as rollers. On the other hand, the alumina fiber precursor has the nature that it tends to shrink as a whole although the fiber ends are turned into a relatively stretched state as a result of the high-temperature heat treatment (calcination).

In the system of FIG. 1, therefore, a specific conveyor with little hitching propensity is disposed in the front treating chamber (11) and another specific conveyor having high-temperature heat resistance and a certain degree of slipperiness against precursor (W) is disposed in the rear treating chamber (12) to realize smooth conveyance of precursor (W). Thus, the said conveying mechanism comprises a metal mesh conveyor (2) disposed in the front treating chamber (11) and a refractory porcelain-made roll conveyor (3) disposed in the rear treating chamber (12).

For instance, as the metal mesh conveyor (2), there is used a stainless steel conveyor having a mesh belt comprising ribs with a wire size of about 2 mm disposed at a pitch of approximately 16 mm and spiral wires with a size of about 2 mm disposed at a pitch of approximately 10 mm. Metal mesh conveyor (2) is wound round the tension rollers provided inside and outside of furnace body (1) so that it can enter furnace body (1) from its inlet and extend to a roughly central part of furnace body (1), then is led downwardly of the central part of furnace body (1) and passes beneath the floor of furnace body (1) to circulate back to the inlet of furnace body (1). Although not shown, metal mesh conveyor (2) is usually driven by a motor set outside of furnace body (1) through driving rollers disposed at the inlet section or under the floor of furnace body (1).

A refractory porcelain conveyor is used as roller conveyor (3). Mullite can be cited as an example of refractory porcelain composing such a conveyor. The diameter of roller conveyor (3) is specified to be 25 to 40 mm in view of the area of contact with precursor (W), slipperiness and other factors. The reason why the diameter of roller conveyor (3) is defined in the above range is as explained below.

If the roller diameter of roller conveyor (3) is set to be less than 20 mm, the roller itself becomes liable to bend when heated and also surface bend is enlarged to promote entanglement of fibers, making the conveyor liable to hitch and also causing a possibility of crush of fibers. On the other hand, if the roller diameter is made greater than 40 mm, the conveying force for the fiber aggregate (W) is lowered since the pitch of wire arrangement is enlarged. When the pitch is narrowed by using the rollers with a greater diameter, strength of the side wall of furnace body (1) may drop. Although not shown, roller conveyor (3) is usually driven by a motor set outside of furnace body (1) through chains passed round the sprockets of arbors projecting from the side of furnace body (1).

In the present invention, as described above, calcination of precursor (W) is carried out by subjecting the precursor to a heat treatment while conveying it in one direction by the conveying mechanism disposed in the furnace, viz. the said metal mesh conveyor (2) (punching metal sheet conveyor) and roller conveyor (3). The greatest feature of the present invention resides in that in order to prevent fiber crush during conveyance of precursor (W) with even more certainty, the speed of each unit of the said conveying mechanism is reduced progressively in the direction of conveyance in correspondence to the rate of heat shrinkage of precursor (W).

The conveying speed of roller conveyor (3) is set at a lower level than that of metal mesh conveyor (2). More specifically, the rate of heat shrinkage (rate of shrinkage in length) of precursor (W), though variable depending on the composition, is, for instance, about 20 to 30%. So, in the said furnace, the conveying speed of roller conveyor (3) is set at, for instance, 60 to 80% of that of metal mesh conveyor (2) in correspondence to the rate of heat shrinkage of precursor (W). The average conveying speed of the said conveying mechanism as a whole is decided by the time of treatment and the furnace length, but for instance the conveying speed of metal mesh conveyor (2) is set at around 50 to 500 mm/min and the conveying speed of roller conveyor (3) is set at around 35 to 350 mm/min.

Although not shown, roller coveyor (3) may be divided into plural stages. For instance, roller coveyor (3) may consist of 4 sets of unit conveyor arranged successively. In this case, the conveying speeds of the respective units of roller conveyor may be set, for instance, at 85%, 80%, 75% and 70%, respectively, of the conveying speed of metal mesh coveyor (2), as viewed from the upstream side, whereby it is possible to prevent fiber crush with even more certainty.

The heat treatment (calcination) of precursor in the present invention is as explained above. That is, in the furnace shown in the drawing, for instance, preliminary heating is carried out at a temperature below 500° C. in the front treating chamber (11), and then heat treatment is further conducted at a temperature of not lower than 500° C., up to 1,250° C., in the rear treating chamber (12) (see FIG. 1 (*b*)).

When heating is carried out in the front treating chamber (11) with a low temperature, wire mesh coveyor (2) composing the conveying mechanism of the front treating chamber (11) supports the supplied precursor (W) at many points, making it possible to lessen the area of contact with precursor (W). Therefore, like the alumina fiber precursor at the start of supply, the fiber itself is sensitive to water and absorbs ambient moisture to become tacky, and even when precursor (W) with its fiber ends looped is treated with an organic polymer such as polyvinyl alcohol in the front treating chamber (11), it is possible to lessen hitch of fibers, and consequently, in the front treating chamber (11), it is possible to convey precursor (W) with certainty by metal mesh coveyor (2) without impairing the shape of precursor as a whole.

Also, when heating is conducted in the high-temperature rear treating chamber (12), the refractory porcelain-made roller coveyor (3) composing the conveying mechanism of this rear treating chamber (12) supports at the face the precursor (W) sent from front treating chamber (11) and displays a proper degree of slipperiness. Therefore, even when precursor (W), in which the organic polymer has been heated and the fiber ends have been carbonized and stretched by the treatment in front treating chamber (11), and which also has high shrinkability, is treated in rear treating chamber (12), there takes place little hitch of fibers. Consequently, in rear treating chamber (12), precursor (W) can be conveyed for sure by roller conveyor (3) without impairing its shape as a whole.

Further, in the present invention, by reducing the speed of roller coveyor (3) relative to the said metal mesh coveyor (2) correspondingly to the heat shrinkage of precursor (W), it is possible to positively reduce friction with roller coveyor (3) even when precursor (W) is shrunk by the heat treatment in rear treating chamber (12). In other words, in rear treating chamber (12), the conveying speed of roller coveyor (3) is preset in correspondence to the drop of moving speed of precursor (W) by shrinkage, so that it is possible to reduce friction between precursor (W) and roller coveyor (3) and to prevent fiber crush in precursor (W) with certainty. Therefore, according to the production process of the present invention using the said specific furnace, it is possible to produce homogeneous and high-strength alumina fiber blankets which are free of crushed fibers.

As for the composition of the alumina fiber blankets obtained according to the process of the present invention, preferably alumina accounts for 65 to 97% by weight of the composition and the rest is silica. Especially, fiber of a mullite composition with 72 to 85% by weight of alumina excels in high-temperature stability and resiliency and is preferable alumina fiber. Crystalline alumina fiber excels in heat resistance and is very limited in heat deterioration such as softening or shrinkage as compared with non-crystalline ceramic fiber of the same alumina-silica system. That is, crystalline alumina fiber has the properties that it can generate a strong restoring force with a low bulk density and is minimized in change with temperature.

Also, the high-temperature furnace shown in FIG. 1 is not limited in its application to the production of alumina fiber blankets but can also be applied to the aggregates of other inorganic fibers obtained by the same production method as used for alumina precursor fiber.

The process for producing continuous blankets of alumina fibers according to the present invention is useful for the production of continuous blankets used as various types of heat-resistant materials such as heat insulators or joint fillers for high-temperature furnaces or high-temperature ducts, or as retainer of catalyst converters for cleaning exhaust gas from internal combustion engines. Also, as it is possible to surely prevent fiber crush in the alumina fiber precursor in conducting heat treatment of a continuous sheet of alumina fiber precursor in a high-temperature furnace, the process of the present invention is suited for producing homogeneous and higher-strength alumina fiber blankets. cl EXAMPLES Hereinafter, the present invention is explained in further detail by showing the examples thereof, but the present invention is not limited to these examples but can be embodied in other forms without departing from the scope of the invention. In the following examples, heat treatment of the continuous sheet of alumina fiber precursor was conducted by using a high-temperature furnace of the structure shown in FIG. 1. Presence or absence of fiber crush in the alumina fiber blankets was observed visually, but it can be judged by local thinning of the blanket and its surface unevenness (non-uniformity of thickness) as seen from the upper side of the blanket.

Example 1

Silica sol was added to an aqueous solution of basic aluminum chloride (aluminum content=70 g/l; Al/Cl=1.8 (atomic ratio)) so that the finally obtained alumina fiber composition would become $Al_2O_3$:$SiO_2$=72:28 (by weight). Then polyvinyl alcohol was further added, the mixed solution was concentrated to prepare a spinning solution having a viscosity of 40 poises and an alumina/silica content of about 30% by weight, and spinning was conducted using the said spinning solution by the blowing method. The spinning stream containing the formed alumina fiber precursor was let impinge against a wire mesh endless belt and the alumina fiber precursor was collected to obtain a 1,050 mm wide thin-layer sheet with a basis weight of about 40 g/m$^2$, which was relatively non-uniform and had the alumina fiber precursor arranged randomly in the plane. This thin-layer sheet was folded and stacked according to the method described in European Patent Application Laid-Open No. 971057 to obtain a 950 mm wide continuous laminated sheet of alumina fiber precursor comprising 30 layers of thin-layer sheet. This laminated sheet was subjected to needling at a rate of 5 punches/cm$^2$ to mold the sheet into a thickness of 15 mm and a bulk density of 0.08 g/cm$^3$.

Figure 2:
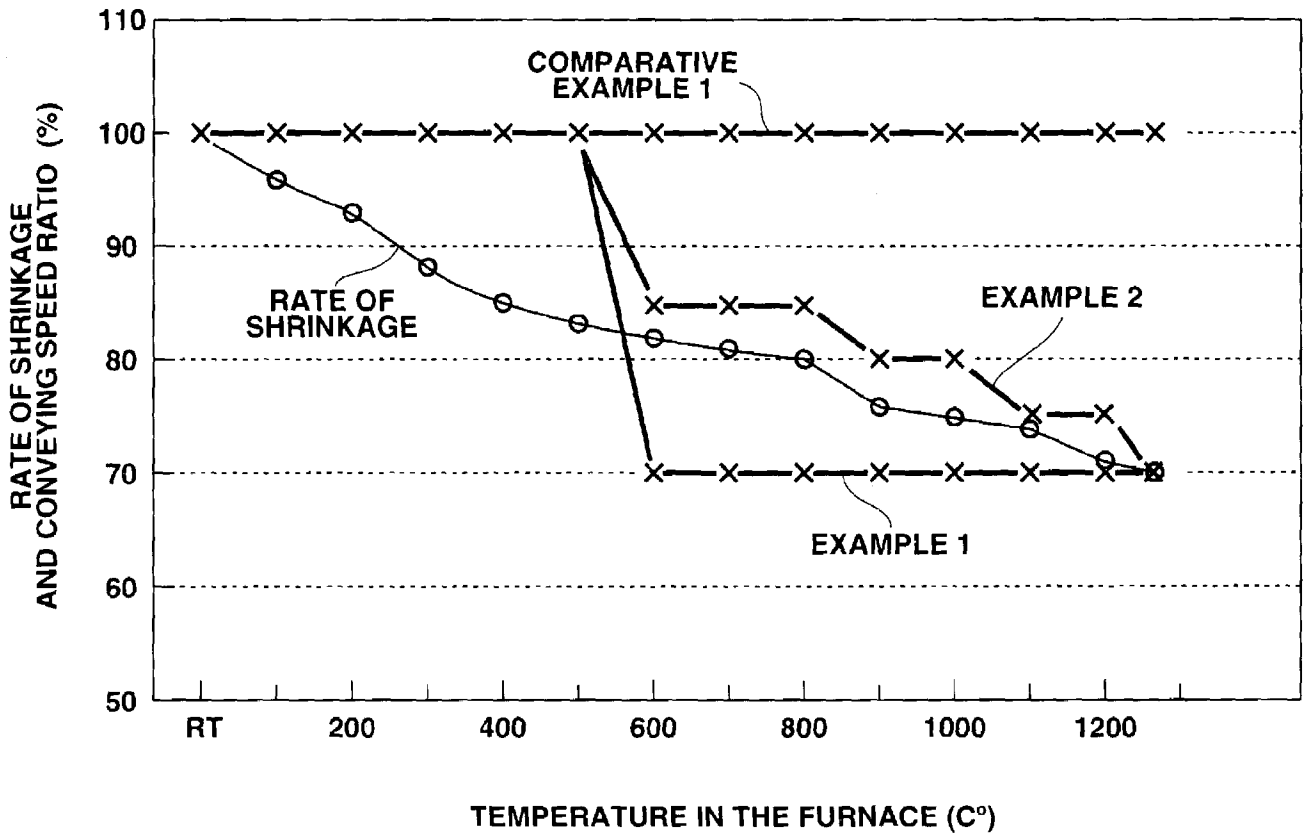
FIG. 2 is a graph showing the relation of the rate of shrinkage of the continuous sheet and the conveying speed ratio to the temperature distribution in the furnace when a continuous sheet of alumina fiber precursor was subjected to the heat treatment in Examples 1 and 2 and Comparative Example 1.

Then, using the high-temperature furnace shown in FIG. 1, the alumina fiber precursor sheet (laminated sheet) was subjected to a heat treatment (calcination) in the following way. That is, the alumina fiber precursor sheet delivered from the folding apparatus was supplied onto metal mesh coveyor (2) and subjected to a 1.5-hour heat treatment at 100 to 500° C. in front treating chamber (11). The conveying speed of metal mesh coveyor (2) was 300 mm/min. Then the sheet was transferred from metal mesh coveyor (2) to roller coveyor (3) and subjected to a 1.5-hour heat treatment at 500 to 1,250° C. and further to a 0.5-hour heat treatment at 1,250° C. in rear treating chamber (12). The conveying speed of roller coveyor (3) was 210 mm/min. The relation of the rate of shrinkage and conveying speed ratio to the temperature distribution in the furnace in the heat treatment of the continuous sheet of alumina fiber precursor in Example 1 is as shown in the graph of FIG. 2.

The above-described heat and calcination treatments in front treating chamber (11) and rear treating chamber (12) gave a continuous alumina fiber blanket having a thickness of about 12 mm, a width of about 670 mm, a bulk density of 0.1 g/cm$^2$ and a basis weight of 1,200 g/m$^2$. Visual observation of the obtained alumina fiber blanket confirmed slight fiber crush at one location in the 20-meter length of the blanket as shown in Table 1.

Example 2

An alumina fiber blanket was produced continuously by conducting the same operations as in Example 1 except that roller coveyor (3) of the conveying mechanism of the high-temperature furnace consisted of 4 units of conveyor, and that the conveying speeds of the respective units of conveyor were set at 85%, 80%, 75% and 70%, respectively, of the conveying speed of metal mesh coveyor (2), that is, at 255 mm/min, 240 mm/min, 225 mm/min and 210 mm/min, respectively, from the upstream side of conveyor. The relation of the rate of shrinkage of the continuous sheet and conveying speed ratio to the temperature distribution in the furnace in the heat treatment of the continuous sheet of alumina fiber precursor in Example 2 is as shown in the graph of FIG. 2. In the obtained alumina fiber blanket, no fiber crush was confirmed as shown in Table 1.

Comparative Example 1

An alumina fiber blanket was produced continuously by conducting the same operations as in Example 1 except that in the heat treatment (calcination) of the thin-layer sheet, the speed of the conveying mechanism of the high-temperature furnace was not reduced progressively in the direction of conveyance but kept constant. The relation of the rate of shrinkage of the continuous sheet and conveying speed ratio to the temperature distribution in the furnace in the heat treatment of the continuous sheet of alumina fiber precursor in Comparative Example 1 is as shown in the graph of FIG. 2. In the obtained alumina fiber blanket, fiber crush was confirmed at four locations in the 20-meter length of the blanket as shown in Table 1.

TABLE 1

| | Conveying speed of conveying mechanism (metal mesh conveyor (2)/roller conveyor (3) speed ratio) | Locations of fiber crush (number of locations in 20-meter length of blanket) |
|---|---|---|
| Example 1 | 100/70 | 1 |
| Example 2 | (Roller conveyor (3) consists of 4 units of conveyor) | 0 |
| Comparative Example 1 | 100/100 | 4 |

As explained above, according to the continuous alumina fiber blanket producing process of the present invention using a specific furnace, the conveying speed of the conveying mechanism is preset in correspondence to the drop of the moving speed of the alumina fiber precursor sheet caused by its shrinkage, so that it is possible to lessen friction between the alumina fiber precursor sheet and the conveying means, and to positively prevent fiber crush in the sheet, making it possible to produce the homogeneous, higher-strength alumina fiber blankets which are free of crushed fibers.

Also, according to the high-temperature furnace used in the present invention, each conveyor in the front and rear treating chambers remains safe from catching or hitching fibers in the fiber aggregates such as alumina fiber precursor to allow smooth and secure conveyance of the fiber aggregates, so that the heat treatment can be conducted more smoothly without impairing the initial shape of the fiber aggregates, and further, since the fibers in the fiber aggregates are never crushed, homogeneity and sufficient strength are ensured for the fiber aggregates such as alumina fiber blankets as the obtained product.

What is claimed is:

1. A process for producing a continuous alumina fiber blanket which process comprises continuously supplying into a high-temperature furnace a continuous sheet of alumina fiber precursor formed from a spinning solution containing an aluminum compound, and subjecting the sheet to heat treatment while conveying it in one direction by a conveying mechanism disposed in said high-temperature furnace, the speed of said conveying mechanism being reduced progressively in the direction of conveyance in correspondence to the rate of heat shrinkage of the continuous sheet of alumina fiber precursor.

2. The process according to claim 1, wherein the speed of the conveying mechanism is reduced intermittently in the direction of conveyance in accordance with the rate of heat shrinkage of the continuous sheet of alumina fiber precursor.

3. The process according to claim 1, wherein the conveying mechanism comprises a metal mesh conveyor or a punching metal sheet conveyor disposed in the front treating chamber in the high-temperature furnace, and a refractory porcelain-made roller conveyor disposed in the rear treating chamber.

4. The process according to claim 1, wherein the continuous sheet of alumina fiber precursor is supplied into the high-temperature furnace after undergoing needle punching.

5. The process according to claim 1, wherein the heat treatment is conducted at a highest temperature of 1,000 to 1,300° C. in the high-temperature furnace.

6. The process according to claim 1, wherein the alumina fiber blanket composition comprises 65 to 97% by weight of alumina and the remaining percent of silica.

* * * * *